US005598253A

United States Patent [19]

Yagi

[11] Patent Number: 5,598,253

[45] Date of Patent: Jan. 28, 1997

[54] LIQUID DEVELOPER APPARATUS AND METHOD USING TWO DIFFERENT BIAS VOLTAGES FOR PREVENTING FOG IN THE BACKGROUND OF AN IMAGE

[75] Inventor: Atsushi Yagi, Hachioji, Japan

[73] Assignee: Olympus Optical Co., Ltd., Tokyo, Japan

[21] Appl. No.: 523,790

[22] Filed: Sep. 5, 1995

[30] Foreign Application Priority Data

Sep. 7, 1994 [JP] Japan ..... 6-213570

[51] Int. Cl.[6] ..... G03G 15/10

[52] U.S. Cl. ..... 399/240; 399/57

[58] Field of Search ..... 355/246, 256, 355/264, 265; 118/647, 659, 660, 652

[56] References Cited

U.S. PATENT DOCUMENTS 4,875,080 10/1989 Kimura et al. ..... 355/246

5,063,398 11/1991 Murai et al. ..... 347/115

FOREIGN PATENT DOCUMENTS 61-179478 8/1986 Japan ..... 355/256

1-185569 7/1989 Japan .

4-51068 2/1992 Japan .

*Primary Examiner*—Joan H. Pendegrass

*Attorney, Agent, or Firm*—Frishauf, Holtz, Goodman, Langer & Chick

[57] ABSTRACT

A liquid developer apparatus comprises a developer unit for applying a liquid developer to an electrostatic latent image formed on a recording medium, and a switch circuit for selectively outputting to the developer unit one of a first bias voltage and a second bias voltage which has the same polarity as that of the electrostatic latent image and is higher than the first bias voltage. The switch circuit outputs the second bias voltage during a predetermined period of time other than a period of time in which the electrostatic latent image is developed.

12 Claims, 5 Drawing Sheets

LIQUID DEVELOPER APPARATUS AND METHOD USING TWO DIFFERENT BIAS VOLTAGES FOR PREVENTING FOG IN THE BACKGROUND OF AN IMAGE

BACKGROUND OF THE INVENTION

1. Field of the Invention

This invention relates to a liquid developer apparatus and method for bringing a liquid developer into contact with a recording medium having an electrostatic latent image, and more particularly to a liquid developer apparatus and method with a function for removing surplus toner in a liquid developer and cleaning the apparatus.

2. Description of the Related Art

A liquid developer apparatus for forming an electrostatic latent image on a recording sheet such as a recording paper sheet, and developing the image on the recording sheet with the use of a liquid developer containing toner has conventionally been used as a recording apparatus for recording an image on a recording sheet of a large size such as "A0" size.

Such a conventional liquid developer apparatus is disclosed, for example, in Japanese Patent Application KOKAI Publication No. 1-185569. This apparatus has a single electrostatic recording head and a plurality of liquid developer units for liquid developers of different colors. In the apparatus, a color image is recorded on a recording paper sheet by reciprocating the sheet.

In general, to develop, by a developer apparatus, an electrostatic latent image of a minus potential recorded on a recording medium, a liquid developer containing a toner charged with plus electricity is used. In this case, application of a minus voltage to the developer unit prevents movement of plus electricity-charged toner particles toward an image background portion of the recording medium, thereby preventing occurrence of fog in the background portion.

However, there is a case where the liquid developer contains toner particles charged with electricity of an opposite polarity (i.e. a minus potential) because of insufficient adjustment of electric characteristics. Furthermore, the liquid developer may gradually deteriorate with the passing of time, resulting in an increase in the amount of toner particles charged with electricity of the opposite polarity. Thus, if a minus voltage is applied to the developer unit which receives a liquid developer containing both toner particles charged with electricity of a predetermined polarity and those charged with electricity of a polarity opposite to the former, the toner particles charged with electricity of the opposite polarity, i.e. charged with minus electricity, repel the developer unit charged with minus electricity, and stick to the electrostatic recording paper sheet, thereby increasing the degree of fog in the image background portion.

Moreover, there is a developer unit with a developer groove formed in its upper surface, which groove serves as a passage of a liquid developer when a recording paper sheet has been placed on the developer unit to close the groove. In this developer unit, that portion of the upper surface of the unit which contacts the recording paper sheet serves as a developer electrode. Toner particles between the upper surface and the recording paper sheet are attracted by the recording paper sheet and adhered thereto when an electrostatic latent image has been formed thereon. Therefore, when that portion of the recording paper sheet which has a high potential has passed a corresponding upper surface portion of the developer unit, toner particles on the corresponding upper surface portion are completely removed, and the corresponding upper surface portion has its metal ground exposed (in other words, the upper surface portion is cleaned).

On the other hand, toner particles remain on that upper surface portion of the developer unit on which the high potential portion of the recording paper sheet has not passed. If in this state, the developer unit is moved downward and separated from the recording paper sheet, the toner particles remain on the unit, and stick thereto after the solvent of the developer evaporates. Where toner particles cover part of the upper surface of the developer unit, the characteristics of the developer unit as a developer electrode are degraded, and an image formed on that portion of the recording paper sheet which corresponds to the toner-covered portion of the developer unit will inevitably have a low toner concentration.

If a different image is recorded on a new recording paper sheet by means of the above-described partially toner-coated developer unit, that portion of the image which corresponds to the completely toner-removed portion of the developer unit has a high toner concentration, and the other portion of the image has a low toner concentration. This means that the newly recorded image is influenced by the previously recorded image.

SUMMARY OF THE INVENTION

It is a first object of the invention to provide a liquid developer apparatus and method capable of removing toner particles of an opposite polarity contained in a liquid developer, thereby to prevent occurrence of fog in the background of an image due to the toner component of the opposite polarity.

It is a second object of the invention to provide a liquid developer apparatus and method capable of removing toner particles on a developer unit and keeping the surface of the unit clean so as to prevent the influence of a previously recorded image upon an image to be recorded.

According to a first aspect of the invention, there is provided a liquid developer apparatus comprising: a developer unit for applying a liquid developer to an electrostatic latent image formed on a recording medium and having a predetermined polarity; a voltage generation circuit for generating a first bias voltage and a second bias voltage which has the same polarity as the electricity of the electrostatic latent image and is higher than the first bias voltage; a switch circuit for selectively outputting one of the first and second bias voltages to the developer unit; and a control circuit for controlling the switch circuit such that the switch circuit outputs the second bias voltage during a predetermined period of time other than a period of time in which the electrostatic latent image is developed.

According to a second aspect of the invention, there is provided a liquid developer apparatus comprising: a developer unit for applying a liquid developer to an electrostatic latent image formed on a recording medium and having a predetermined polarity; a voltage generation circuit for generating a first bias voltage and a second bias voltage which has a polarity opposite to that of the first bias voltage; a switch circuit for selectively outputting one of the first and second bias voltages to the developer unit; a control circuit for controlling the switch circuit such that the switch circuit outputs the second bias voltage during a predetermined period of time in which an image region corresponding to the electrostatic latent image is located outside the developer unit.

According to a third aspect of the invention, there is provided a developing method comprising the steps of:

applying a liquid developer to an electrostatic latent image formed on a recording medium and having a predetermined polarity; generating a first bias voltage and a second bias voltage which has the same polarity as that of the electrostatic latent image and is higher than the first bias voltage; and applying the second bias voltage to the developer unit during a predetermined period of time other than a period of time in which the electrostatic latent image is developed.

According to a fourth aspect of the invention, there is provided a developing method comprising the steps of: applying a liquid developer to an electrostatic latent image formed on a recording medium and having a predetermined polarity; generating a first bias voltage and a second bias voltage which has a polarity opposite to that of the first bias voltage; applying the second bias voltage to the developer unit during a predetermined period of time in which an image region corresponding to the electrostatic latent image is located outside the developer unit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The embodiments of the invention will be explained with reference to the accompanying drawings.

(First Embodiment)

Figure 1:
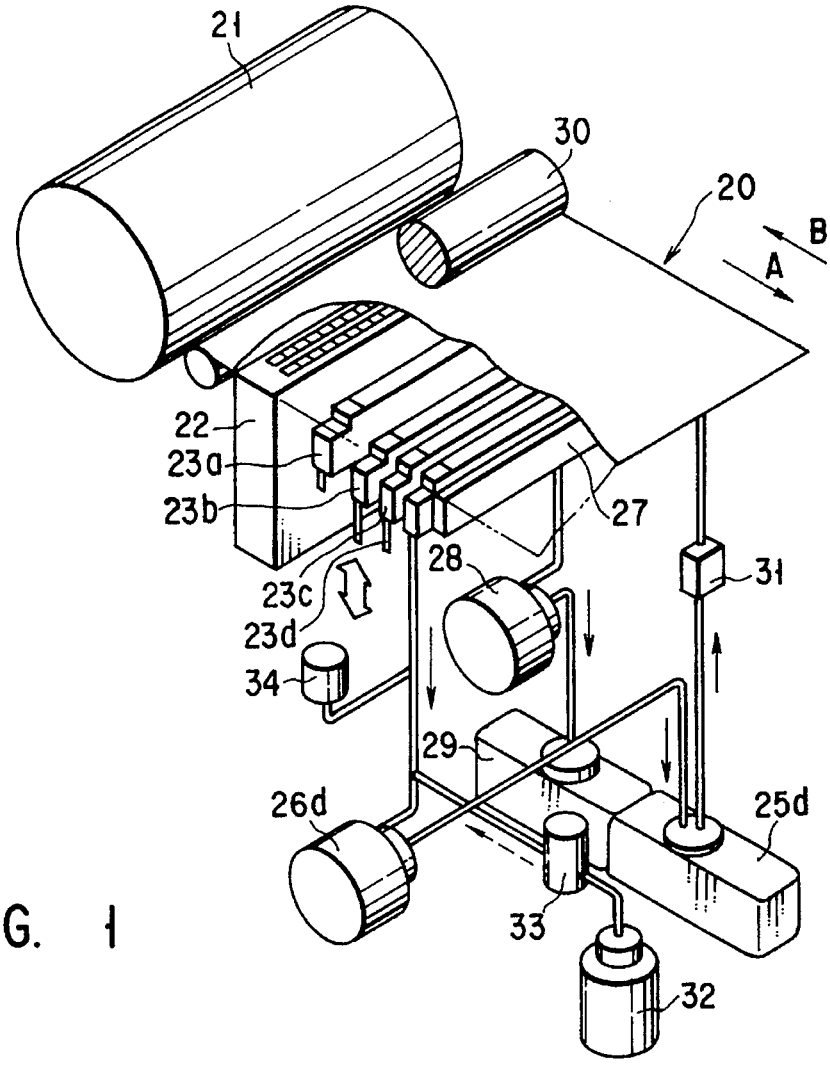
FIG. 1 is a schematic view, showing a liquid developer apparatus.

FIG. 1 shows an electrostatic recording paper roll 21 formed by winding on a base paper sheet an electrostatic recording paper sheet coated with a dielectric for holding an electrostatic latent image. An electrostatic paper sheet 20 is fed from the electrostatic recording paper sheet 21. A multi-stylus electrostatic recording head 22 is located across a predetermined portion of a feed path of the electrostatic recording paper sheet 20. The recording head 22 comprises a multiple of electrode needles arranged across the feed path with a predetermined pitch.

A press roller 30 is opposed to the multi-stylus electrostatic recording head 22 for pressing the electrostatic recording paper sheet 20 against the head. Developer units 23*a*–23*d* which constitute a liquid developer apparatus are arranged along the feed path of the sheet 20. The developer units 23*a*–23*d* receive liquid developers of different colors. Specifically, the units 23*a*–23*d* receive liquid developers of cyanogen, magenta, yellow and black colors, respectively.

Figure 2:
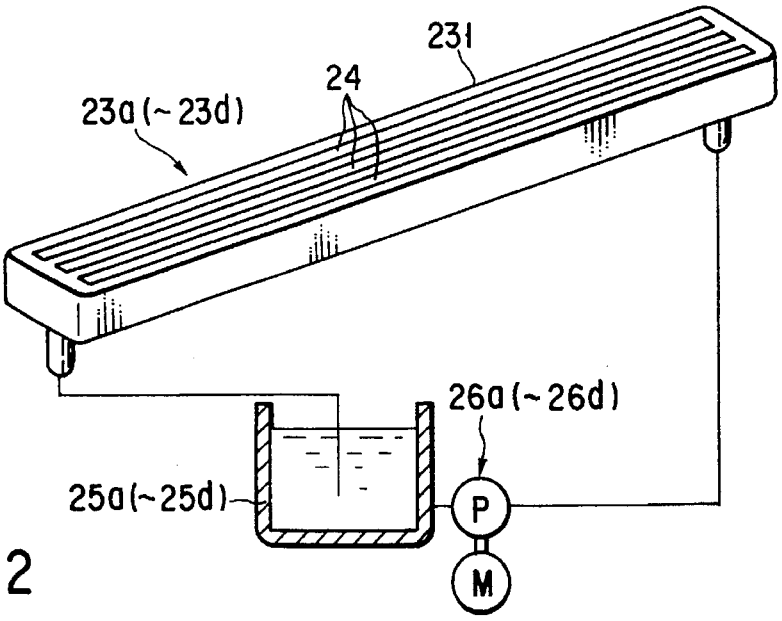
FIG. 2 is a schematic view, showing a developer head employed in the liquid developer apparatus shown in FIG. 1.

FIG. 2 is an enlarged view, showing the developer unit 23*a* (–23*d*). As is shown in FIG. 2, the developer unit has a plurality of developer supply grooves 24 formed in an upper surface of a strip base 231. An end of each of the grooves 24 is connected to a developer tank 25*a* (–25*d*), and the other end is connected to a developer pump 26*a* (–26*d*). The developer tanks 25*a*–25*d* receive liquid developers of cyanogen, magenta, yellow and black colors, respectively, and are connected to the developer units 23*a*–23*d* via respective pipes. The developer pumps 26*a*–26*d* are dedicated to the respective colors, and interposed between the developer units 23*a*–23*d* and the developer tanks 25*a*–25*d*, respectively.

As is shown in FIG. 1, the electrostatic recording paper sheet 20 fed from the electrostatic recording paper sheet roll 21 is reciprocated in directions indicated by arrows A and B. Whenever the paper sheet 20 reciprocates one time, an image of one color which is included in a multi-color image is recorded in a predetermined print region of the sheet 20. As a result, images of all colors are superposed to form a multi-color image in the print region. Further, the electrostatic recording head 22 is commonly used to record images of different colors. Specifically, the head 22 forms on the recording paper sheet 20 an electrostatic latent image corresponding to each color, and the resultant latent images are developed with liquid developers of corresponding colors.

To develop electrostatic latent images formed on the electrostatic recording paper sheet 20, that one of the developer units 23*a*–23*d* which corresponds to a color to be developed is moved up to the feed path of the sheet 20 and brought into contact with the sheet 20. At this time, the other developer units are retreated below the feed path. Where one of the developer units 23*a*–23*d* is moved up to the feed path, that one of the developer pumps 26*a*–26*d* which corresponds to that developer unit is operated to suck the recording paper sheet 20 by means of a negative pressure (vacuum pressure).

If the developer unit 23*a* is moved up to the transfer path of the paper sheet 20, the developer pump 26*a* is operated to generate a suction force at the developer supply grooves 24 of the developer unit 23*a*. Then, the recording paper sheet 20 is attracted to the upper surface of the developer unit 23*a* and closes the developer supply grooves 24 formed therein, with the result that the negative pressure in the grooves of the developer unit 23*a* is further reduced, and hence the liquid developer in the developer tank 25*a* is sucked into the grooves 24. The sucked developer passes through the developer unit 23*a* and returns into the tank 25*a* through the developer pump 26*a*. The liquid developer is thus circulated.

While being transferred on the transfer path, the recording paper sheet 20 contacts the liquid developer in the developer supply grooves 24 of the developer unit 23*a*, and an electrostatic latent image on the sheet is developed. After completing development of a developer of a designated color, the developer unit 23*a* is moved down to a position below the feed path of the sheet 20.

When the developer unit 23*a* has been separated from the recording paper sheet 20, part of the liquid developer which remains in the unit 23*a* remains on the recording paper sheet 20. A squeeze head 27, which is connected to a drainage tank 29 via a vacuum pump 28 dedicated thereto, removes the remaining developer and dries the sheet 20. When the vacuum pump 28 has been operated, the liquid developer remaining on the recording paper sheet 20 is removed therefrom and sucked into the drainage tank 29 by means of a suction force created by the pump 28.

In FIG. 1, reference numeral 31 denotes a developer concentration detecting device, reference numeral 32 a high concentration developer tank, reference numeral 33 an electromagnetic valve, and reference numeral 34 a vacuum switch. The high concentration developer tank 32 is provided for supplying toner of high concentration to the liquid developer to keep the toner concentration therein to a predetermined value. The electromagnetic valve 33 is opened on the basis of a signal from the developer concentration detecting device 31.

Figure 3:
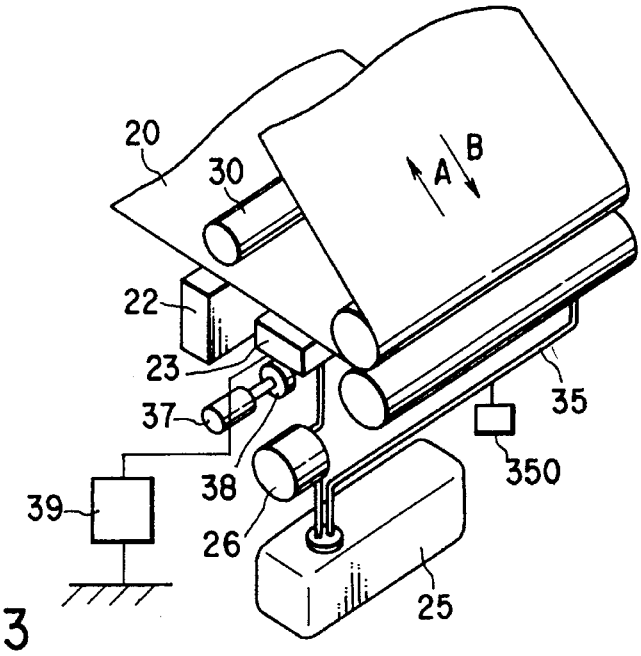
FIG. 3 is a schematic view, showing a developer mechanism for one color employed in the liquid developer apparatus of FIG. 1.

FIG. 3 is a schematic view, showing a developer mechanism for one color employed in the liquid developer apparatus. In FIG. 3, elements similar to those in FIG. 1 are denoted by corresponding reference numerals. The developer unit 23 has a cam 38 at its lower portion. The developer unit 23 is moved in the vertical direction by rotating the cam 38 with a motor 37. The developer unit 23 is connected to a developing bias circuit 39, and therefore can apply a voltage to the main part of the apparatus.

Figure 4:
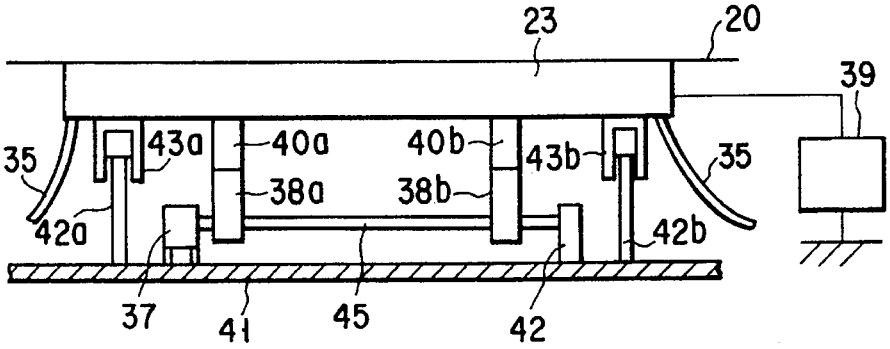
FIG. 4 is a cross sectional view, showing the developer mechanism for one color.

FIG. 4 shows a longitudinal cross section of the developer unit 23 employed in the FIG. 3 developer mechanism and a vertically moving mechanism for vertically moving the unit 23. As is shown in FIG. 4, slide members 43*a* and 43*b* are attached to the lower surface of the developer unit 23 along support poles 42*a* and 42*b*. The slide members 43*a* and 43*b* are provided for vertically moving the developer unit 23. The support poles 42*a* and 42*b* are attached to the main part of the apparatus with an insulating plate 41 interposed therebetween, and hence electrically insulated therefrom.

Cams 38*a* and 38*b* for vertically moving the unit 23 are coupled to the developer unit 23 by means of coupling members 40*a* and 40*b* interposed therebetween. The cams 38*a* and 38*b* are driven by a cam shaft 45 whose one end is connected to a motor 37. The other end of the cam shaft 45 is connected to a shaft support member 42. The motor 37 and the shaft support member 42 are attached to the main part of the apparatus via the insulating plate 41, thereby insulating the developer unit 23 from the main part of the apparatus. Discharge pipes 35 for supplying and discharging the liquid developer into and from the developer unit 23 consist of insulating hoses to insulate the unit 23 from the main part of the apparatus.

As described above, the developer unit 23 is formed of a conductive material such as a metal, etc. The bias circuit 39 is connected between part of the conductive material of the developer unit 23 and the main part of the apparatus so that the bias voltage of the bias circuit 39 can be applied to the developer unit 23. The developer unit 23 serves to supply the liquid developer to the surface of the electrostatic recording paper sheet 20, and also serves as a developer electrode.

As explained above, an electrostatic latent image on the electrostatic recording paper sheet 20 is developed by supplying the liquid developer between the sheet 20 and the developer unit 23 as the developer electrode. Moreover, the developer electrode enables an image free from an edge effect to be obtained. In addition, applying a voltage of the same polarity as that of the electricity of the electrostatic recording paper sheet 20 can prevent occurrence of fog in the background of an image. If the potential of a latent image is about −100 V, applying a voltage of about −5 V to the developer unit 23 can prevent fog in the image background portion.

Figure 5:
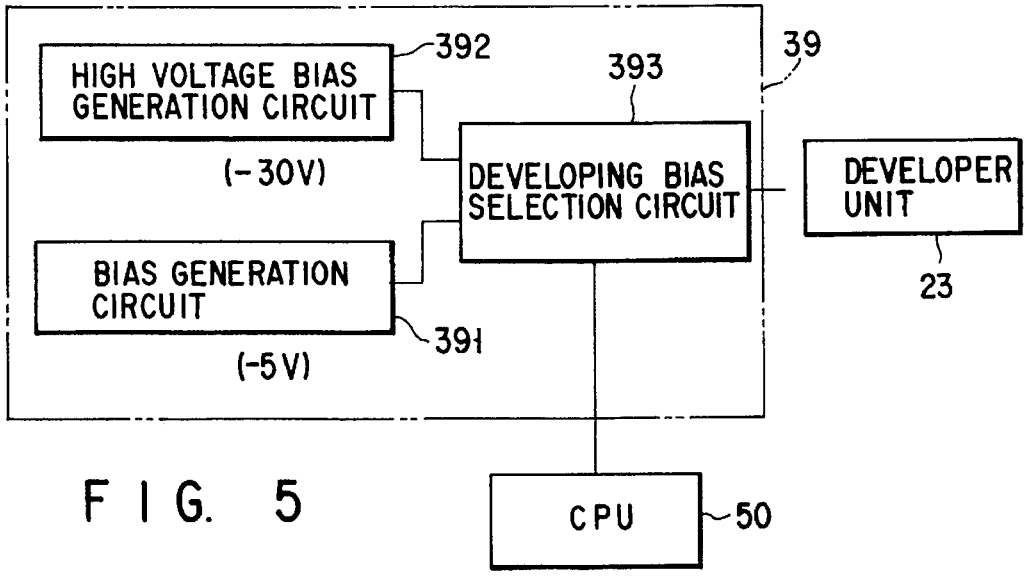
FIG. 5 is a block diagram, showing a liquid developer apparatus according to a first embodiment of the invention.

As is shown in FIG. 5, the developing bias circuit 39 is connected to the developer unit 23. The bias circuit 39 has a bias generation circuit 391, a high voltage bias generation circuit 392 and a developing bias selection circuit 393. The bias generation circuit 391 and the high voltage bias generation circuit 392 are connected to the developing bias selection circuit 393, which is connected to the developer unit 23 and a CPU 50.

During developing an electrostatic latent image, the bias generation circuit 391 outputs a developing bias voltage to the developer unit 23. The developing bias voltage is set to about −5 V when the potential of the latent image on the recording paper sheet 20 is about −100 V. The high voltage bias generation circuit 392 outputs, as the bias voltage, a high voltage of about −30 V having the same polarity as that of the latent image. The developing bias selection circuit 393 is responsive to an instruction from the CPU 50 for selectively outputting, to the developer unit 23, a bias voltage from the bias generation circuit 391 or the high voltage bias generation circuit 392.

In the above-described liquid developer apparatus, suppose that the developer pump 26 is operated with the developer unit 23 (shown in FIG. 3) moved up to the feed path of the recording paper sheet 20. Then, the paper sheet 20 is attracted onto the developer unit 23 by means of a negative pressure generated by the developer pump 26. When the paper sheet 20 has been attached to the upper surface of the developer unit 23, the negative pressure in the unit 23 is further reduced, thereby causing the liquid developer in the developer tank 25 to flow into the developer supply grooves 24 shown in FIG. 2. The flown developer passes the developer unit 23, and returns to the developer tank 25 through the developer pump 26.

While the liquid developer is circulated by operating the developer pump 26, the pressure in the developer pipes 35 is measured by a pressure sensor 350. If the CPU 50 detects that the pressure in the developer pipes 35 is reduced to a value lower than a predetermined value, it outputs a control signal to the developing bias selection circuit 393, which in turn selects a bias voltage from the high voltage bias generation circuit 392. As a result, a bias voltage of −30 V is applied from the bias circuit 392 to the developer unit 23.

In a state where the bias voltage of −30 V is being applied to the developer unit 23, toner particles charged with positive electricity do not stick to that portion of the recording paper sheet 20 which has no latent image formed thereon.

However, toner particles charged with negative electricity scatter over and stick to the recording paper sheet 20. Therefore, when the sheet 20 has been fed in the above state, the toner particles of negative electricity are collected from the liquid developer to the paper sheet 20. Further, when the feed of the sheet 20 has started, the recording head 22 starts to record a latent image on the sheet 20. Here, it should be noted that a certain time is required until the portion at which recording of the latent image is started reaches the developer unit 23. The CPU 50 detects how much the recording paper sheet 20 moves until the latent image start portion of the sheet 20 moves from the recording start position to a position immediately before the developer unit 23. When having detected the amount of the movement, the CPU 50 outputs an instruction to the developing bias selection circuit 393, which in turn selects the bias generation circuit 391 and switches the circuit from the high voltage bias generation circuit 392 to the bias generation circuit 391.

As a result, a bias voltage of −5 V is applied from the bias generation circuit 391 to the developer unit 23. Since the bias voltage applied to the unit 23 is thus low, only a small amount of toner particles of negative electricity stick to the recording paper sheet 20. Thus, the amount of those toner particles of negative electricity which stick to the paper sheet 20 is greatly smaller than that of toner particles of positive electricity. Therefore, even if a regular bias voltage of a minus voltage is applied to the developer unit 23 so as to prevent regular toner particles of positive electricity from sticking to the background of an image, the amount of fog in the background is minimized. Accordingly, an excellent image can be obtained.

Figure 6:
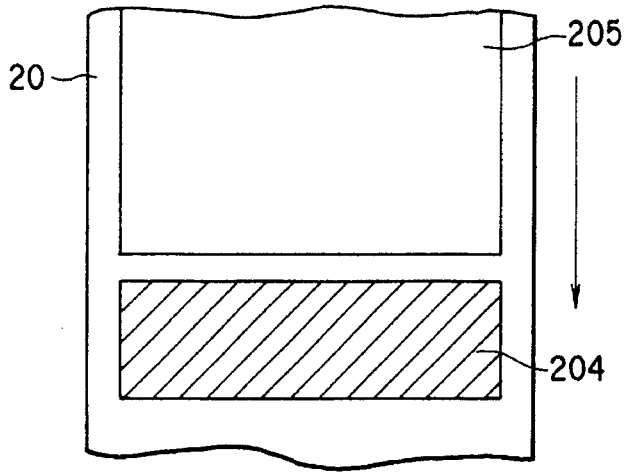
FIG. 6 is a view, showing the state of an image formed on a recording paper sheet which is assumed when the bias voltage to be applied to the liquid developer apparatus of FIG. 5 is switched from one to another.

FIG. 6 shows the state of an image assumed when the bias voltage is switched as explained above. In FIG. 6, the recording paper sheet 20 is transferred in a direction indicated by the arrow. The hatched portion indicates that toner particles of negative electricity stick to a margin 204 of a front portion of an image on the recording paper sheet 20 as a result of applying a bias voltage of −30 V to the developer unit 23. An image is recorded in an image section 205 following to the margin 204, and occurrence of fog in the background of the image can be restrained.

Figure 7:
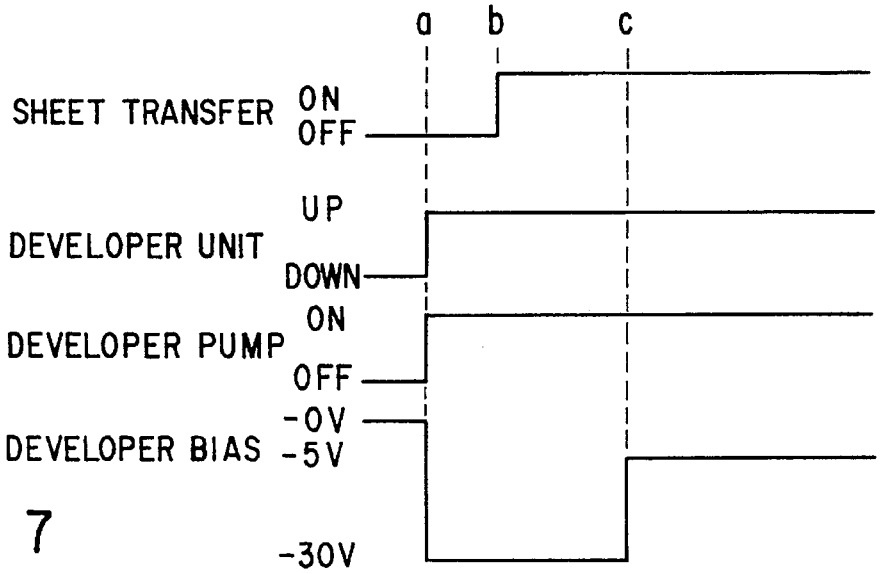
FIG. 7 is a timing chart, useful in explaining the operation of the liquid developer apparatus of FIG. 5.

FIG. 7 is a timing chart, useful in explaining the operation of the liquid developer apparatus. At a time point of "a", the developer unit 23 is raised to the feed path of the recording paper sheet 20 (Developer unit "UP"), and the developer pump 26 is operated (Developer pump "ON"). Then, a bias voltage of −30 V is applied to the developer unit 23 (Developing bias "−30 V"). After the liquid developer is circulated and the pressure in the developer unit 23 is sufficiently reduced, the feed of the recording paper sheet 20 is started at a time point of "b" (Sheet transfer "ON"). Thus, a voltage of −30 V is applied to the developer unit 23 during feed of the paper sheet 20. When a latent image formed on the paper sheet 20 has reached the developer unit 23, at a time point of "c" the bias voltage is changed to a regular voltage of −5 V which is to be applied at the time of development (Developing bias "−5 V"), and development is started.

Although in the first embodiment, a bias voltage of −30 V is applied during the time from the start of operation of the developer pump 26 to the start of development, it may be applied during the time from the completion of development to the stop of the operation of the developer pump 26. Moreover, the bias voltage may be applied both before the start of development and after the completion of development.

As explained above, since in the first embodiment, toner particles of negative electricity in the liquid developer are collected on the margin 204 of the recording paper sheet 20, and the amount of toner particles of negative electricity remaining in the developer is reduced, fog which results from adhesion of toner particles of negative electricity to the background of an image during development can be restrained. In addition, since the amount of toner particles of negative electricity is reduced, the amount of those toner particles of negative electricity is reduced, which stick to an image portion of the recording paper sheet 20 when a regular bias voltage has been applied to the developer unit 23 at the time of development.

(Second Embodiment)

Figure 8:
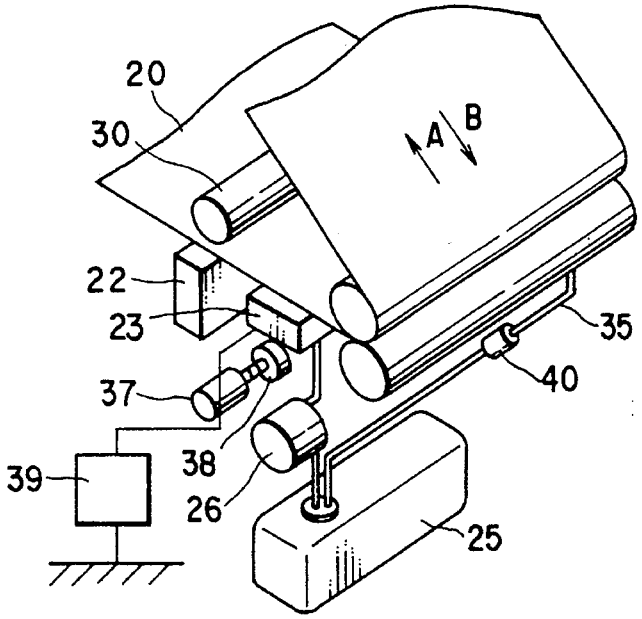
FIG. 8 is a schematic view, showing a developer mechanism for one color employed in a liquid developer apparatus according to a second embodiment of the invention.

FIG. 8 is a schematic perspective view, showing a developing mechanism for one color employed in a liquid developer apparatus according to a second embodiment. In FIG. 8, elements similar to those in FIG. 3 are denoted by corresponding reference numerals. As is shown in FIG. 8, an electromagnetic valve 40 is provided across a pipe 35 which connects the developer tank 25 and the developer unit 23. Although in the second embodiment, the developing bias circuit 39 has a structure similar to that shown in FIG. 5, the high voltage bias generation circuit 392 outputs, as a bias voltage, a high voltage of about +30 V whose polarity is opposite to that of the regular development bias voltage of about −5 V.

Figure 9:
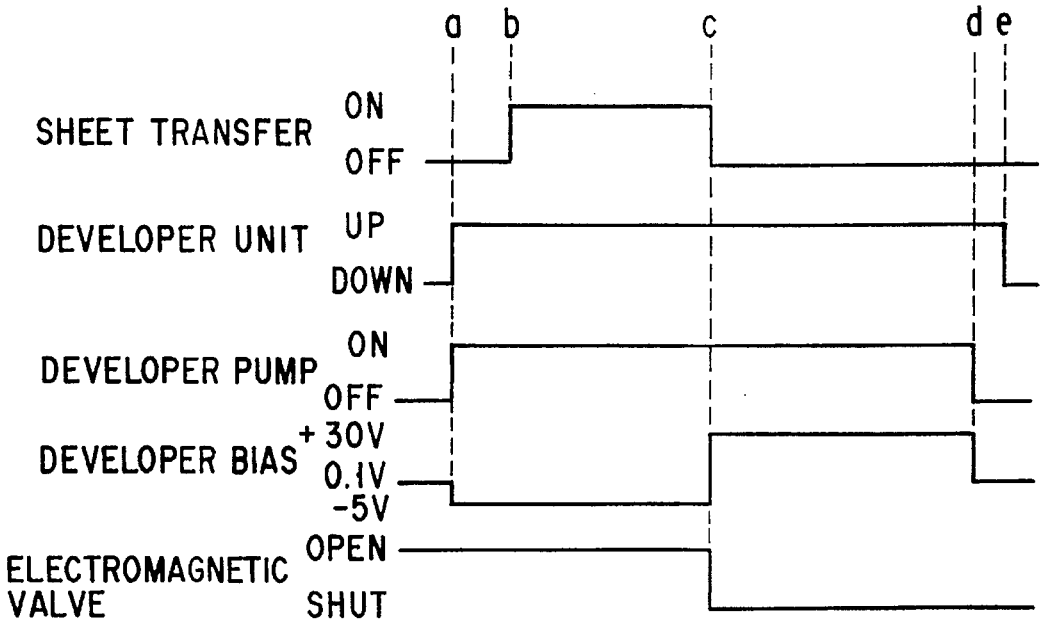
FIG. 9 is a timing chart, useful in explaining the operation of the liquid developer apparatus of FIG. 8.

FIG. 9 is a timing chart, useful in explaining the operation of the liquid developer apparatus of the second embodiment. At a time point of "a", the developer unit 23 is raised to the feed path of the recording paper sheet 20 (Developer unit "UP"), and the developer pump 26 is operated (Developer pump "ON"). Then, a bias voltage of −5 V is applied to the developer unit 23 (Developing bias "−5 V"), thereby reducing the degree of fog in the background of an image.

After the liquid developer is sufficiently circulated, the feed of the recording paper sheet 20 is started at a time point of "b" (Sheet transfer "ON") to start recording of data on the paper sheet 20. When the paper sheet 20 with a latent image has passed the developer unit 23 and development has been completed, the feed of the paper sheet 20 is stopped at a time point of "c" (Sheet transfer "OFF"), and the electromagnetic valve 40 is closed (Electromagnetic valve "SHUT"). At the same time, the bias voltage is set to +30 V (Developing bias "+30 V").

In this state, no more liquid developer is supplied, and the used liquid developer is collected into the developer tank 25 by operating the developer pump 26. At this time, since the developing bias is +30 V, all toner particles in the liquid developer remaining between the developer unit 23 and the paper sheet 20 move to the paper sheet 20 and stick thereto. As a result, the surface of the developer unit 23 is cleared. Thereafter, the developer pump 26 is stopped at a time point of "d" (Developer pump "OFF"), and the application of the bias voltage of +30 V is ceased (Developing bias "0.1 V"). At a time point of "e" at which the negative pressure in the developer unit 23 has returned to the original value, the unit 23 is lowered (Developer unit "DOWN"), followed by the termination of processing.

Although in the second embodiment, the bias voltage of +30 V is applied after the termination of development, it may be applied before the start of development. Alternatively, the bias voltage may be applied both before the start of development and after the termination thereof.

As explained above, since in the second embodiment, the bias voltage of +30 V is applied to the developer unit 23 to remove the toner particles thereon (i.e. to keep the surface of the unit 23 clean), the efficiency of development can be kept high and accordingly an image can be prevented from being adversely affected by a previously recorded image. Further, since the removed toner particles stick to a margin of the paper sheet 20, it is not necessary to employ a particular mechanism for removing the remaining toner particles from the surface of the developer unit 23, i.e., cleaning the developer unit 23.

(Third Embodiment)

The developer unit 23 used in a third embodiment has the same structure as the FIG. 8 unit, and therefore no detailed explanation will be given thereof.

Figure 10:
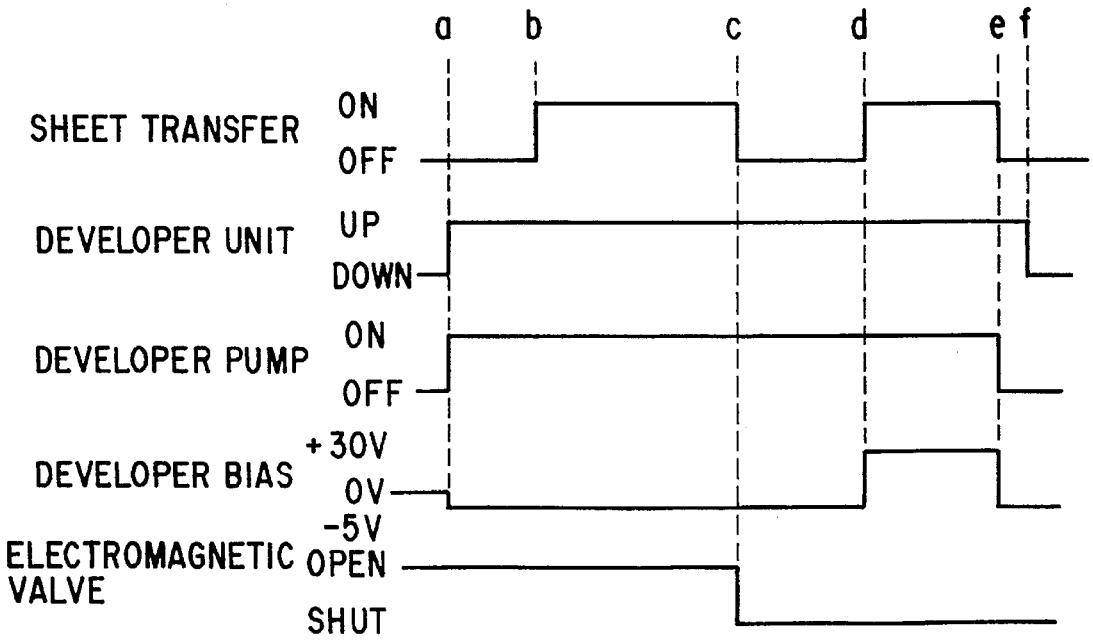
FIG. 10 is a timing chart, useful in explaining the operation of a liquid developer apparatus according to a third embodiment of the invention.

FIG. 10 is a timing chart, useful in explaining the operation of the third embodiment. The basic operation of the third embodiment is similar to that of the FIG. 8 unit. In order to circulate the liquid developer through the developer unit 23, at a time point of "a", the developer unit 23 is raised to the feed path of the recording paper sheet 20 (Developer unit "UP"), and the developer pump 26 is operated (Developer pump "ON"). Then, a bias voltage of −5 V is applied to the developer unit 23 (Developing bias "−5 V") to reduce the degree of fog in the background of an image.

After the liquid developer is sufficiently circulated, the feed of the recording paper sheet 20 is started at a time point of "b" (Sheet transfer "ON") to start recording of data on the recording paper sheet 20. When the paper sheet 20 with a latent image has passed the developer unit 23 and development has been completed, the feed of the paper sheet 20 is stopped at a time point of "c" (Sheet transfer "OFF"), and the electromagnetic valve 40 is closed (Electromagnetic valve "SHUT"). In this state, no more liquid developer is supplied, and the used liquid developer is collected into the developer tank 25 by operating the developer pump 26. Thereafter, when a certain part of the liquid developer has been collected, a developing bias of +30 V is applied to the developer unit 23 (Developing bias "+30 V") and the feed of the paper sheet 20 is resumed (Sheet feed "ON") at a time point of "d". Since the bias voltage is +30 V, toner particles in the liquid developer between the developer unit 23 and the paper sheet 20 move to the paper sheet 20 and stick thereto. The feed of the paper sheet 20 enables the toner particles to stick thereto efficiently.

When all the toner particles have moved to the paper sheet 20, the surface of the developer unit 23 is cleared at a time point of "e". At this time, the developer pump 26 is stopped (Developer pump "OFF"), and the application of the bias voltage of +30 V is ceased (Developing bias "−5 V"). At a time point of "f" at which the negative pressure in the developer unit 23 has returned to the original value, the unit 23 is lowered (Developer unit "DOWN"), followed by the termination of processing.

Although in the third embodiment, the bias voltage of +30 V is applied after the completion of development, it may be applied before the start of development. Alternatively, the bias voltage may be applied both before the start of development and after the termination thereof.

As explained above, since in the third embodiment, the bias voltage is applied while the developer pump 26 is operated to generate a negative pressure, the liquid developer is collected into the developer grooves 24, which enables toner particles on the developer unit 23 to be removed in a short time. Furthermore, that enables the paper sheet 20 to be brought into good contact with the developer unit 23, with the result that the removal of the toner particles by the bias voltage can be performed at high efficiency. In addition, since toner particles are removed while the paper sheet 20 is fed, the surface of the developer unit 23 can be cleaned efficiently in a short time.

(Fourth Embodiment)

Figure 11:
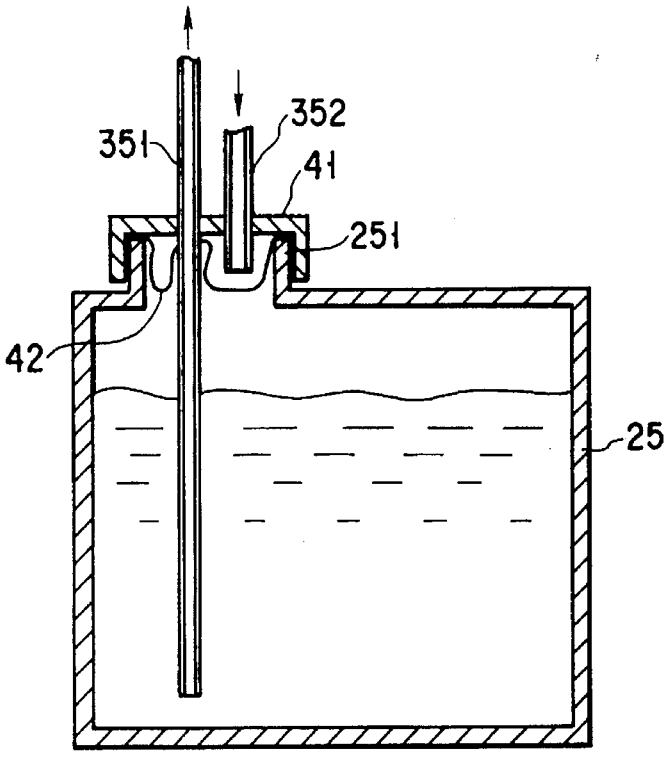
FIG. 11 is a schematic view, showing a developer tank employed in a liquid developer apparatus according to a fourth embodiment of the invention.

FIG. 11 is a schematic view, showing a developer tank 25 employed in a liquid developer apparatus according to a fourth embodiment. As is shown in FIG. 11, an opening 251 is formed at an upper portion of the developer tank 25, and a lid 41 is attached to close the opening 251. A pipe 351 for supplying the liquid developer and a pipe 352 for collecting the developer are provided through the lid 41. The supply pipe 351 is passed into the liquid developer received in the developer tank 25, and the collect pipe 352 is provided above the surface of the liquid developer. A mesh filter 42 is secured to the lid 41 from the inside.

Figure 12:
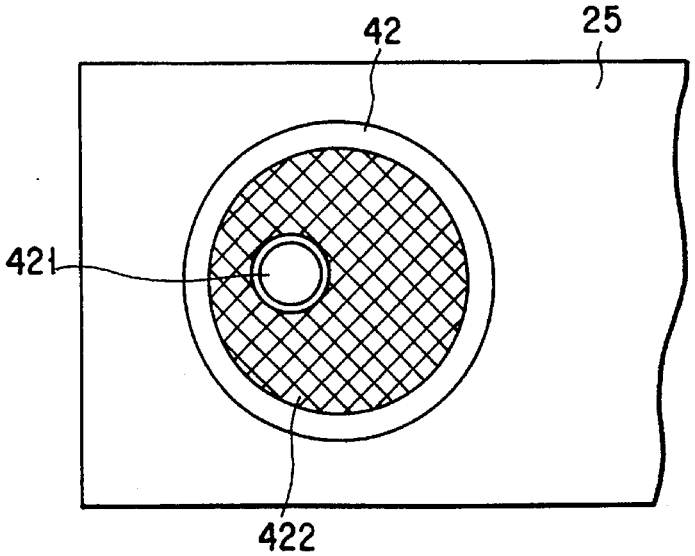
FIG. 12 is a view, showing a mesh filter provided in the developer tank of the liquid developer apparatus of FIG. 11.

FIG. 12 shows the mesh filter 42. As is shown in FIG. 12, the filter 42 has an opening 421 formed eccentric and passing therethrough the supply pipe 351. A mesh surface 422 is interposed between the open end of the collect pipe 352 and the interior of the developer tank 25. As is shown in FIG. 11, the mesh surface 422 has concave portions. Further, the mesh surface 422 has its periphery secured to the edge of the opening 251. By virtue of this structure, the liquid developer is collected through the pipe 352 into the developer tank 25, but a foreign material contained therein is received in the concave portions of the mesh surface 422 and hence prevented from entering a deeper portion of the tank.

Thus, the liquid developer is collected into the developer tank 25 through the pipe 352 and the mesh surface 422 of the filter 42, while a foreign material, such as gathered toner or paper dust, contained in the developer is trapped in the concave portions of the mesh surface 422.

As described above, in the fourth embodiment, the pipes 351 and 352 can be detached from the developer tank 25 together with the lid 41 at the time of exchanging the developer tank 25 to a new one. Further, when a new developer tank 25 with a new liquid developer is set, the filter 42 is simultaneously exchanged to a new one. Thus, the hands of the user or service man are protected from the liquid developer, etc. at the time of exchanging filters. Moreover, since the filter can be exchanged together with the developer tank after the liquid developer is used for a predetermined period of time, circulation of the liquid developer can be prevented from interruption due to filter choking.

The invention is not limited to the above-described embodiments, but may be modified in various manners. For example, although in the embodiments, the electrostatic latent image has a negative potential, it may have a positive potential. In this case, however, the polarities of all the bias voltages should be inverted (i.e. positive and negative voltages should be changed to negative and positive voltages, respectively) to obtain the same effect as described above. It is a matter of course to invert the polarity of toner particles.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A liquid developer apparatus comprising:

a developer unit for applying a liquid developer to an electrostatic latent image formed on a recording medium and having a predetermined polarity;

voltage generation means for generating a first bias voltage and a second bias voltage which has the same polarity as the electricity of the electrostatic latent image and is higher than the first bias voltage;

switch means for selectively outputting one of the first and second bias voltages to the developer unit; and control means for controlling the switch means such that the switch means outputs the second bias voltage during a predetermined period of time other than a period of time in which the electrostatic latent image is developed.

2. The liquid developer apparatus according to claim 1, further comprising a recording head for forming the electrostatic latent image on the recording medium, and feed means for feeding the recording medium at least between the recording head and the developer unit.

3. The liquid developer apparatus according to claim 1, further comprising a tank receiving the liquid developer, and a pump for collecting the liquid developer from the developer unit to the tank to circulate the liquid developer.

4. The liquid developer apparatus according to claim 3, further comprising time set means for setting the predetermined period of time to at least one of a period of time from the start of operation of the pump to the start of development of the electrostatic latent image, and a period of time from the termination of the development of the electrostatic latent image to the cessation of the operation of the pump.

5. The liquid developer apparatus according to claim 3, further comprising a recording head for forming the electrostatic latent image on the recording medium, and feed means for feeding the recording medium at least between the recording head and the developer unit.

6. The liquid developer apparatus according to claim 5, further comprising time set means for setting the predetermined period of time to at least one of a period of time from the start of operation of the pump to the start of development of the electrostatic latent image, and a period of time from the termination of the development of the electrostatic latent image to the cessation of the operation of the pump.

7. A developing method comprising the steps of:

applying a liquid developer to an electrostatic latent image formed on a recording medium and having a predetermined polarity;

generating a first bias voltage and a second bias voltage which has the same polarity as that of the electrostatic latent image and is higher than the first bias voltage; and applying the second bias voltage to the developer unit during a predetermined period of time other than a period of time in which the electrostatic latent image is developed.

8. The developing method according to claim 7, further comprising the steps of supplying the liquid developer into a tank, and circulating the liquid developer from the developer unit to the tank by means of a pump.

9. The developing method according to claim 8, further comprising the step of setting the predetermined period of time to at least one of a period of time from the start of operation of the pump to the start of development of the electrostatic latent image, and a period of time from the termination of the development of the electrostatic latent image to the cessation of the operation of the pump.

10. The developing method according to claim 8, further comprising the steps of forming the electrostatic latent image on the recording medium by means of a recording head, and feeding the recording medium at least between the recording head and the developer unit.

11. The developing method according to claim 10, further comprising the step of setting the predetermined period of time to at least one of a period of time from the start of operation of the pump to the start of development of the electrostatic latent image, and a period of time from the termination of the development of the electrostatic latent image to the cessation of the operation of the pump.

12. The developing method according to claim 7, further comprising the steps of forming the electrostatic latent image on the recording medium by means of a recording head, and feeding the recording medium at least between the recording head and the developer unit.

* * * * *